United States Patent [19]

Hansen et al.

[11] 4,191,592

[45] Mar. 4, 1980

[54] GLASSWASHER

[76] Inventors: William A. Hansen, 95 Ashland Ave., Winnipeg, Manitoba; William A. Conly, 720 Vaughn Ave., Selkirk, Manitoba, both of Canada

[21] Appl. No.: 2,865

[22] Filed: Jan. 11, 1979

[30] Foreign Application Priority Data

Jan. 20, 1978 [CA] Canada ..... 295366

[51] Int. Cl.[2] ..... B08B 3/02; B08B 9/08

[52] U.S. Cl. ..... 134/48; 134/53; 134/81; 134/152

[58] Field of Search ..... 134/46–48, 134/52–53, 56 R–57 R, 80–81, 152

[56] References Cited

U.S. PATENT DOCUMENTS

| | | | |
|---|---|---|---|
| 2,561,631 | 7/1951 | Negri | 134/57 R |
| 2,574,069 | 11/1951 | Stanley | 134/152 X |
| 3,094,997 | 6/1963 | Nolte et al. | 134/48 X |
| 3,878,856 | 4/1975 | Hall | 134/80 X |
| 3,942,545 | 3/1976 | Flynn | 134/80 X |

FOREIGN PATENT DOCUMENTS

| | | | |
|---|---|---|---|
| 522272 | 3/1956 | Canada | 134/152 |

*Primary Examiner*—Robert L. Bleutge
*Attorney, Agent, or Firm*—Cushman, Darby & Cushman

[57] ABSTRACT

The invention relates to a compact glasswasher having wash and rinse tanks and a circular glass conveyor located thereabove, rotation of the conveyor controlling emptying and re-filling of the rinse tank.

3 Claims, 7 Drawing Figures

GLASSWASHER

This invention relates to glasswashers. Conveyorized glasswashers, per se, are known c.f.i. Canadian Specification No. 522,272 which issued on March 6th, 1956 to W. H. Barrie which, for the purpose of its design, has been more than adequate. However, the cost of space occupied by known glasswashers is, by today's standards, extremely expensive. Moreover the water usage of such machines is very high and this is a real cause for concern. Hence, the object of the invention is to overcome these disadvantages by providing a glasswashing machine which will conserve space as well as reducing the amount of water—particularly rinse water—used during a glasswashing operation.

The invention is illustrated, by way of example, in the accompanying drawings in which.

Figure 2:
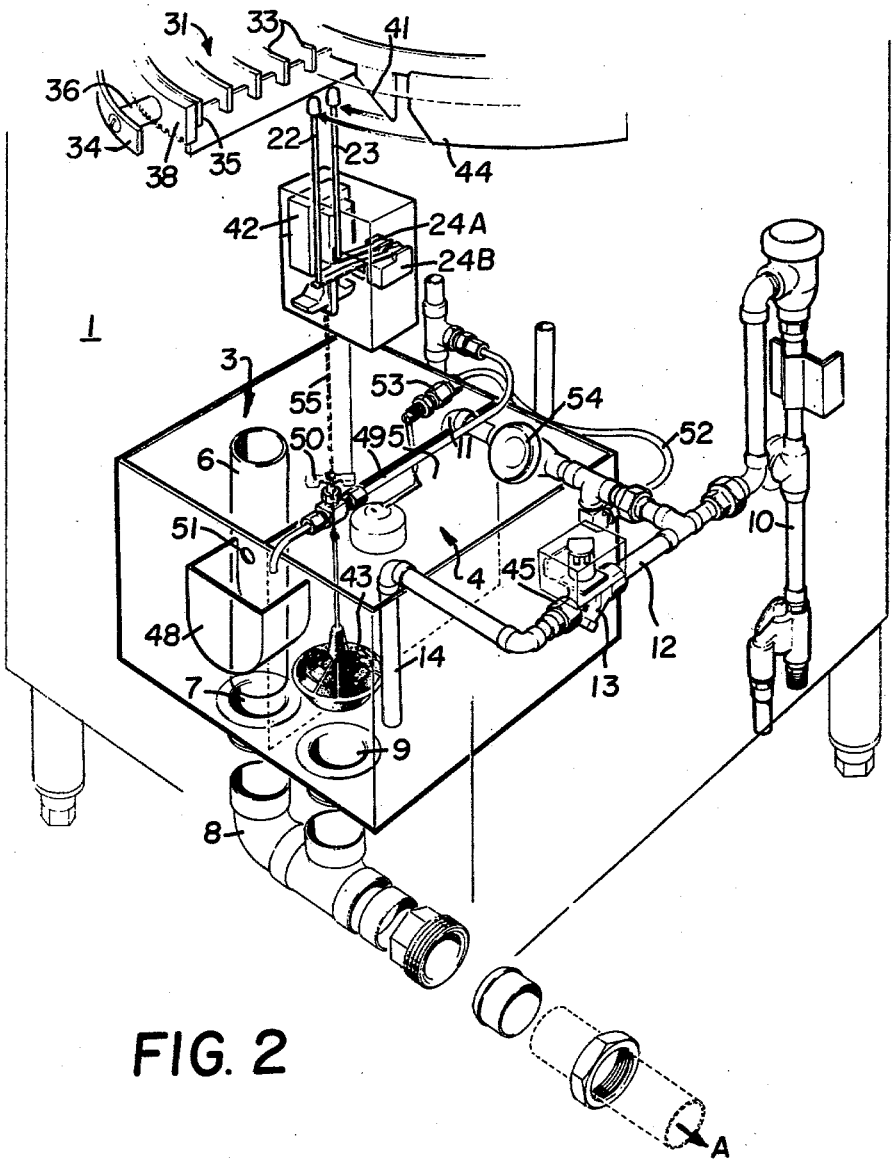
FIG. 2 is a partly exploded perspective view of the interior of the cabinet of the glasswasher of the present invention with certain parts being omitted for the purpose of clarity.
Figure 3:
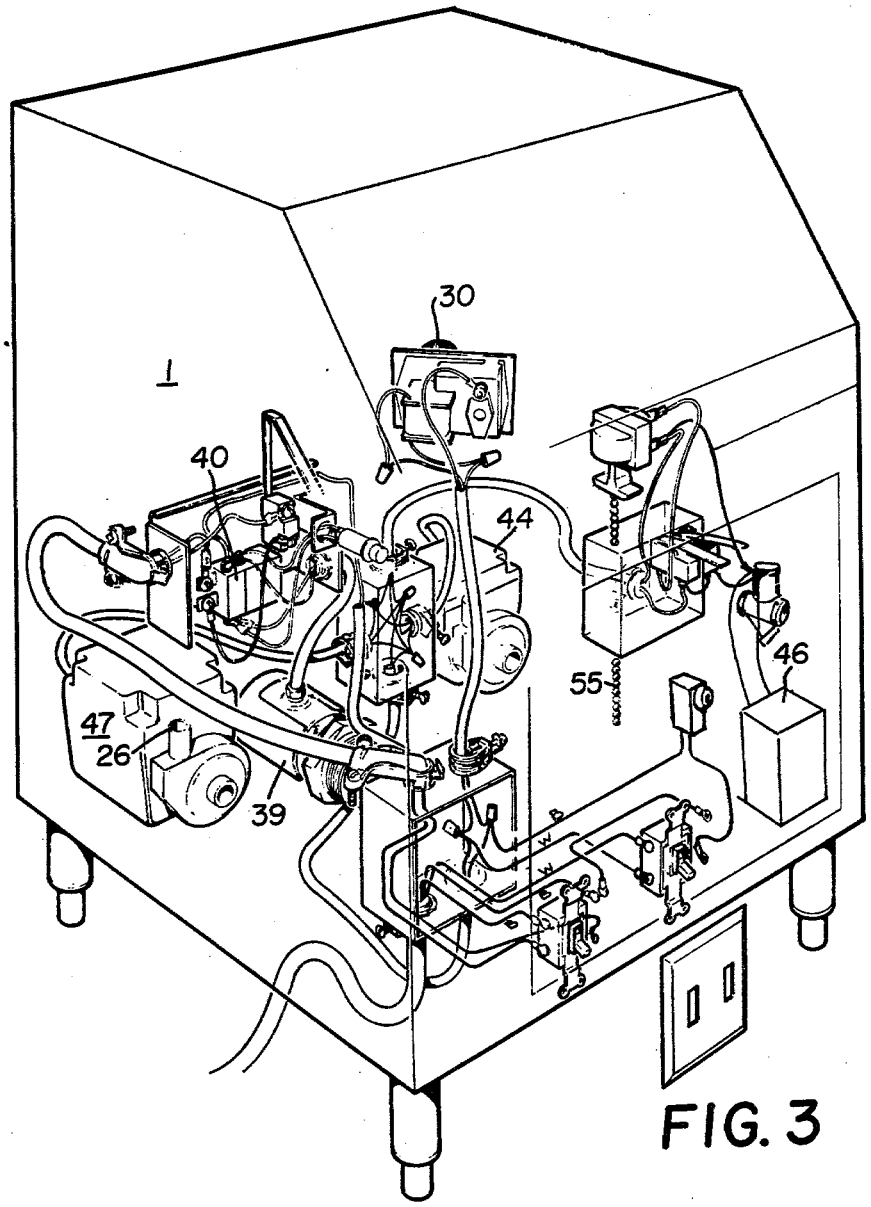
FIG. 3 is a further partly exploded perspective view of the interior of the cabinet of the glasswasher of the present invention and disclosing other parts of the same not shown in FIG. 2.
Figure 7:
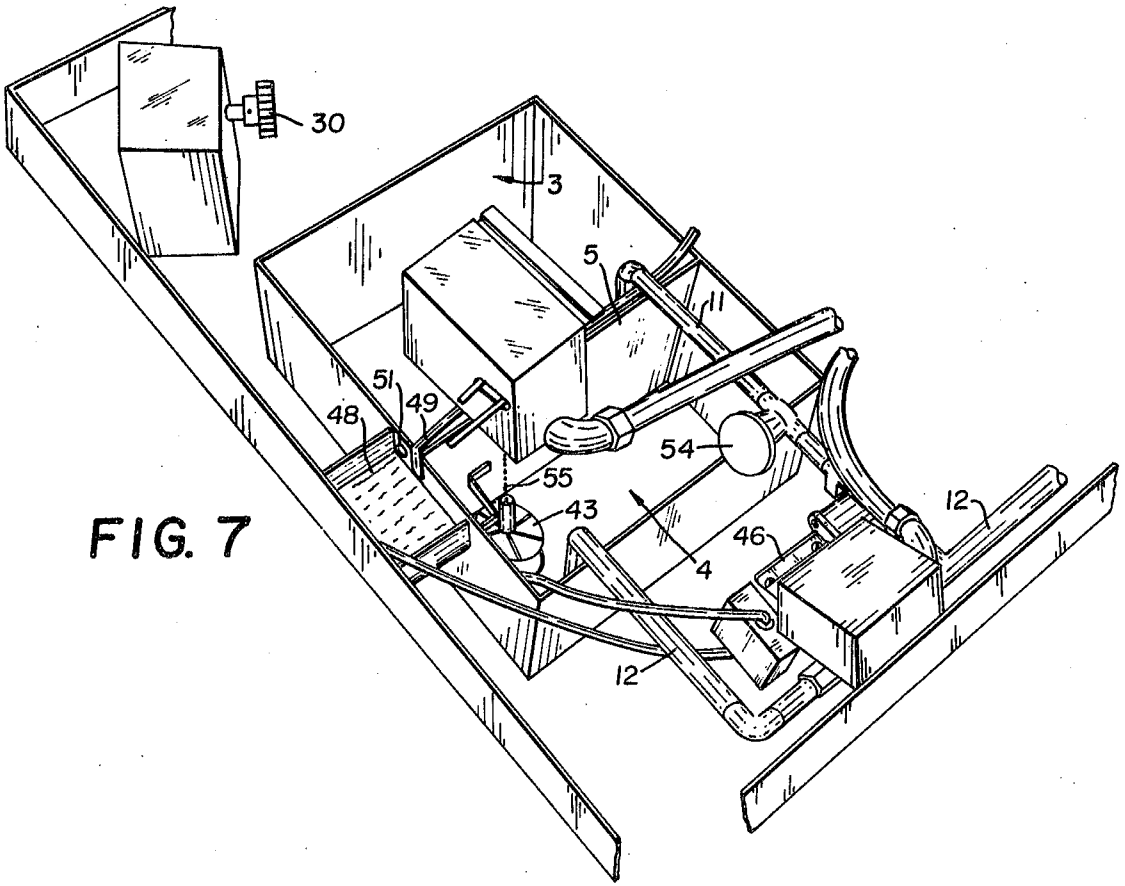
FIG. 7 is a fragmentary perspective view from above and showing the wash and rinse tanks.

Referring to the drawings, the glasswasher includes a cabinet 1 which may be mounted on legs so as to be static or which may, if desired, be wheeled so as grant some limited movement. The cabinet is also provided with door 2 (FIG. 1) in order that access may be obtained to its contents. The cabinet contains non-communicating wash 3 and rinse 4 tanks (FIGS. 2 and 7) separated by a wall 5. The rinse tank 4 holds approximately 2 gallons of water. The wash tank 3 is provided with an overflow pipe 6 communicating with an outlet 7 located at the bottom of the tank and, via, pipe 8, to drain A. The wash solution in tank 3 is heated by means of an immersion heater 39 (FIG. 3) controlled by a thermostat 40. Similarly, the rinse tank 4 communicates with pipe 8 via outlet 9.

Water is supplied to the wash tank 3 from the public utility via pipes 10 and 11 (FIG. 2) and to the rinse tank 4 via pipe 12, solenoid valve 13 and pipe 14.

Figure 4:
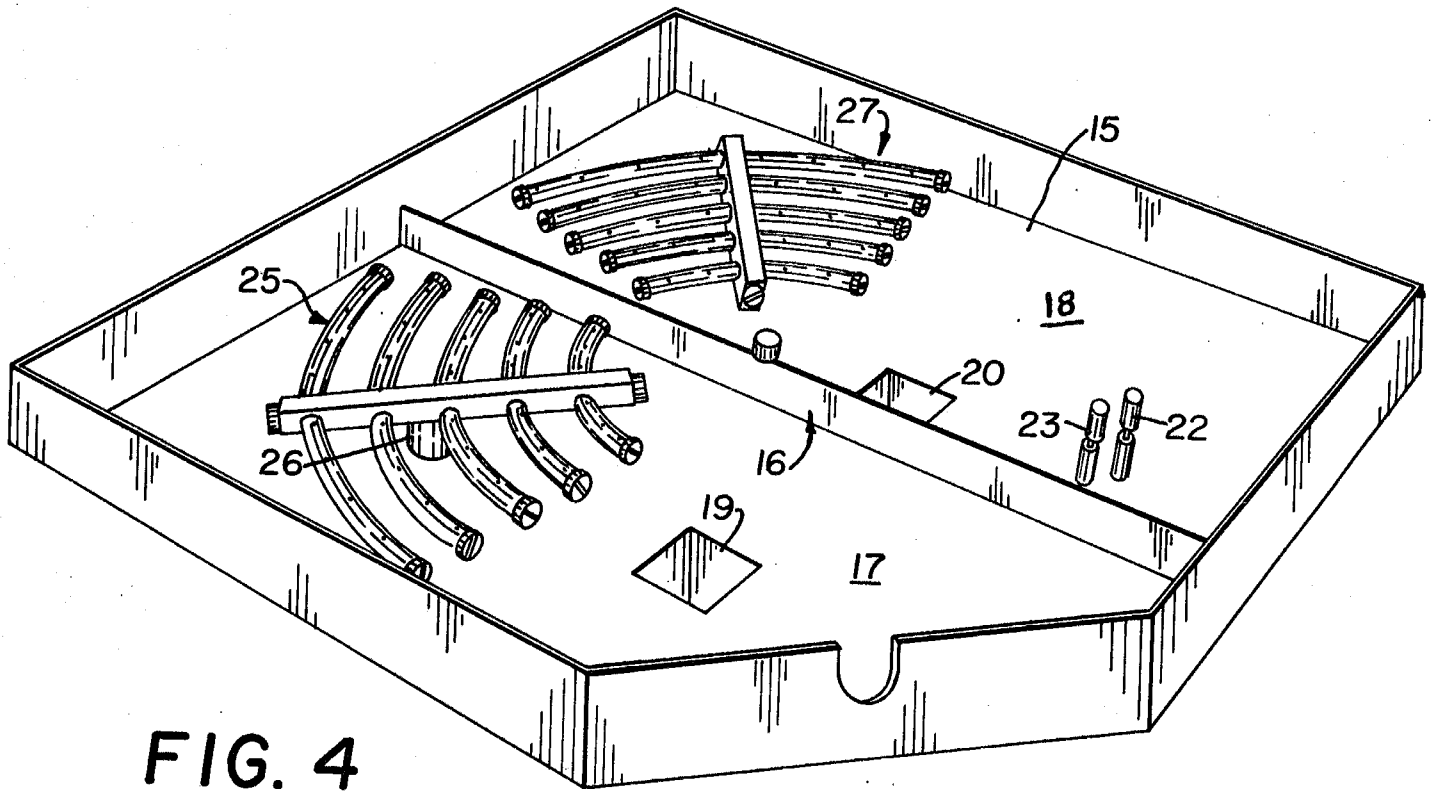
FIG. 4 is a perspective view of the pan above the wash and rinse tanks disclosing the associated spray header and tube assemblies for the wash and rinse areas.

Located above the tanks 3 and 4 is a pan 15 (FIG. 4) divided, by means of a wall 16, into a wash-water area 17, and a rinse water area 18, each of the areas 17, 18 respectively, communicating with the tanks 3,4 by means of outlets 19, 20 located in the bottom of the pan 15. As will be seen from FIG. 1 the pan is provided with a spindle 21 and a pair of plungers 22, 23 (FIG. 2) connected to micro-switches 24A and 24B. The wash area 17 is provided with an arcuate spray header and tube assembly 25 (FIG. 4) connected, via pipe 26 to a wash pump 47. Similarly, the rinse area 18 is provided with an arcuate spray header and tube assembly 27 connected, via pipe 28, to a rinse pump 44.

Figure 1:
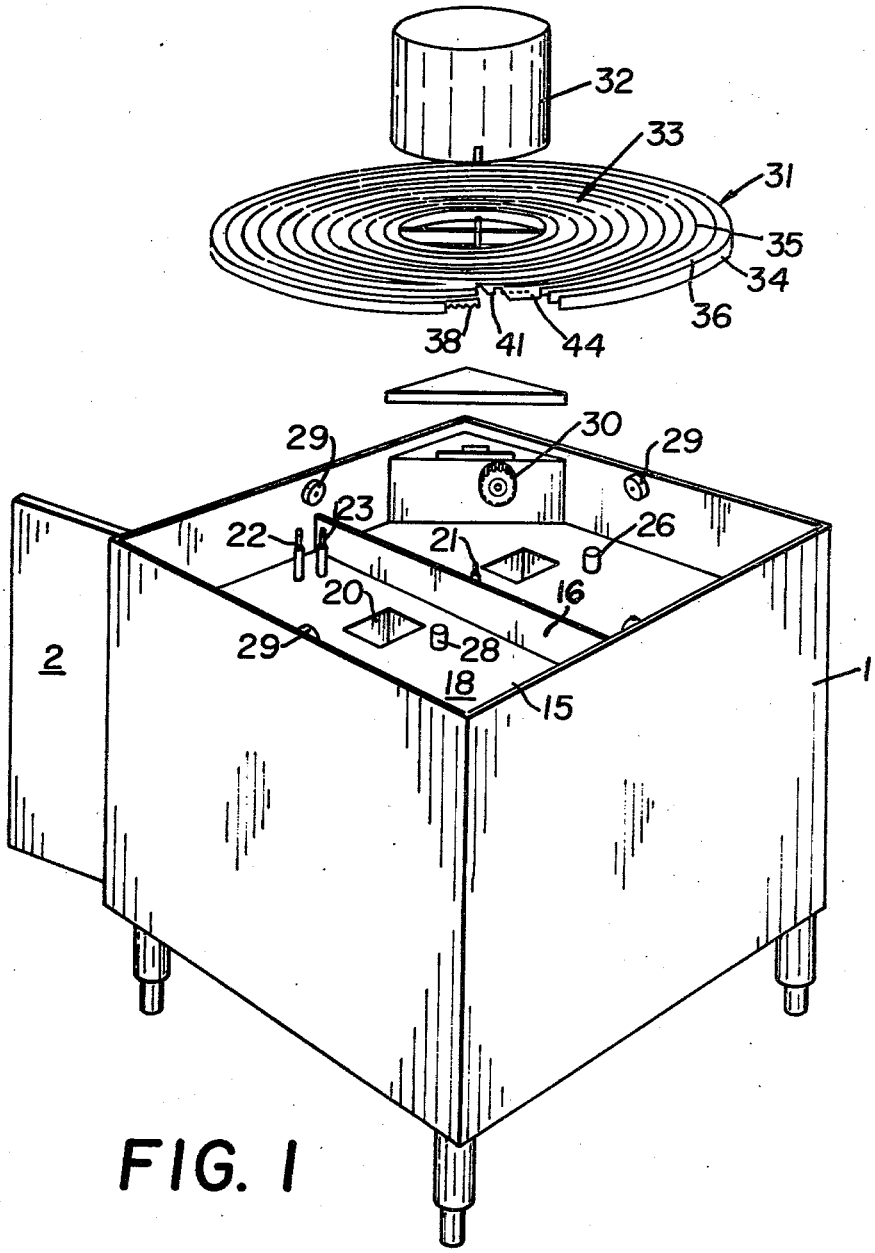
FIG. 1 is a partly exploded perspective view of the upper pan portion of the glasswasher of the present invention, certain parts being omitted for the purpose of clarity.
Figure 5:
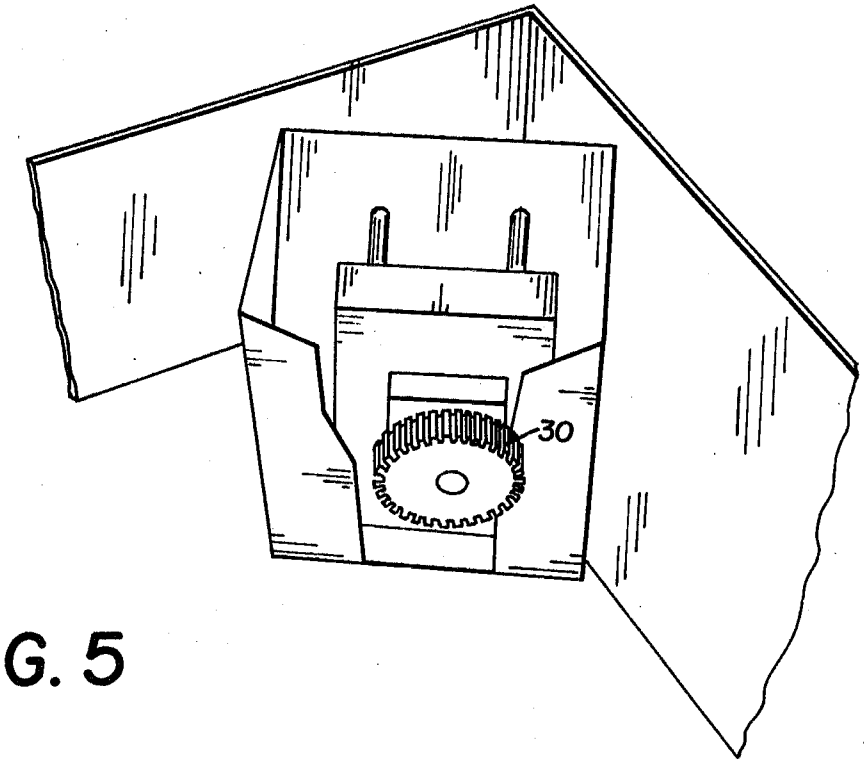
FIG. 5 is an enlarged fragmentary perspective view disclosing the spur gear for rotating the perimeter gear.
Figure 6:
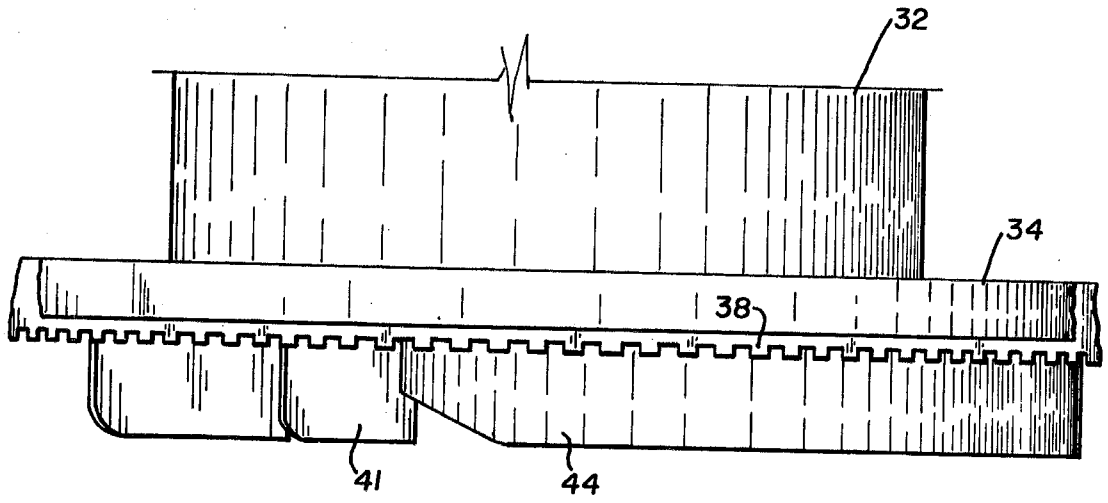
FIG. 6 is an enlarged fragmentary side elevational view of the perimeter gear.

Mutually disposed walls of the upper part of the cabinet 1 (and in the area of the pan 15) are each provided with a roller 29 (FIG. 1) and one corner of the cabinet is provided with a spur gear drive 30 (FIGS. 1 and 5).

Mounted for rotation on the spindle 21 and rollers 29 is a rotatable glass conveyor means 31 (FIG. 1) disposed about a central deflector 32. The means 31 include a plurality of concentric rings 33, the outermost 34 of which is attached to the next innermost ring 35 by spacers 36.

Secured to the ring 35 is a perimeter gear 38 engagable by the spur gear 30 for a positive rotational drive of the conveyor means at a constant speed of approximately ⅓ of a revolution per minute. Once per revolution of the conveyor means, a first trip lever 41 on the underside of one of the rings 33 contacts and depresses plunger 23 momentarily to close micro-switch 24A thereby actuating push-pull solenoid 42. Actuation of the latter raises a rubber stopper 43 to open outlet 9 in the rinse tank 4 and permitting the water therein to escape to the drain A through pipe 8. The solenoid 42 drops back immediately but as the stopper 43 is attached to the solenoid by a flexible chain 55, the stopper 43 will float on the surface as the tank empties until such time as the suction draws the stopper back onto its seat 9. Continuing rotation of the conveyor means 31 causes a second trip lever 44 on the underside of another ring 33 to contact and depress plunger 22 thereby closing micro-switch 24B and energizes water solenoid 13 opening water line 14 thus filling the rinse tank. A flow control device is incorporated in the solenoid valve 13 such that the fill height of the rinse tank can be predetermined by the length of the trip lever 41, as the trip lever depresses the plunger 22 for a time interval which is determined by rotation speed of the conveyor 31.

Rinse pump 44, which is constantly running, then delivers a high volume rinse from the tank 4 to the rinse spray header 27 and over the glasses with the rinse water then returning to the rinse tank through a strainer basket (not shown). As the machine employs cold rinse water, a chemical sanitizer must be added to this water because health codes of certain countries require such a sanitizer to be included if the rinse water is not 180° F. This is accomplished by installing a flow control device 45 (forming part of solenoid valve 13) in the fresh water line 12 supplying the rinse tank 4. The flow control device 45 guarantees that, regardless of upstream pressure, the flow to the rinse tank during the refilling cycle will remain constant. A positive pressure sanitizer injection pump 46 is wired across the solenoid valve 13 feeding the rinse tank 4. Accordingly, when the solenoid valve 13 is energized as described above to refill the rinse tank 4, the injector pump 46 will also be energized and the sanitizer injected into the water supply line 12 at a steady rate. This injected sanitizer chemical flow coupled with the constant water flow guarantees a constant concentration of sanitizing chemical in the rinse water at all times.

A hopper 48 (See FIG. 2) mounted on the front of the tanks 3 and 4 serves as a reservoir for powdered detergent. A feed line 49 delivers a regulated flow of hot solution to the hopper 48, the flow being regulated by valve 50 and dissolving the detergent before the mixture passes out of the hopper 48 through outlet 51 into the wash tank 3.

A branch line 52 leading from line 11 feeds a float operated water make-up valve 53 which maintains a predetermined level of the mixture constant in the wash tank 3 and a valve 54 (also shown in FIG. 2) permits the operator of the machine again to fill the wash tank 3 after it has been drained and cleaned.

As will be appreciated, in operation, dirty glasses are placed on the conveyor means 31 and the power switched on. The means 31 will be rotated by the gear 30 unless the means 31 becomes jammed due to a foreign object interventing whereupon the spur gear 30 will jump in the driven gear until the glasses and conveyor means 31 are removed for clearance of said object. If no obstruction is encountered, the heated wash solution issuing from spray header 25 will circulate over and within the dirty glasses under pressure controlled by pump 47 mounted on the side of the wash tank 3. Continued rotation of the conveyor means 31 then activates the rinse spray cycle as described above.

From the above description, it will be appreciated that an extremely compact and efficient glasswasher has been provided and one in which a 3 minute recycled rinse is possible guaranteeing that a fresh tank of water will rinse only what can be placed on the conveyor means 31 in one revolution thereof. The recirculated rinse feature provides up to 85% saving in water usage and is most noteworthy in today's water and environmental conscious society.

We claim:

1. A glasswashing machine having a glass washing section and a glass rinsing section; a wash tank and a rinse tank communicating with a drain; a washing spray assembly located above said wash tank and a rinsing spray assembly located above the rinse tank; rotatable glass conveyor means located above said assemblies, said conveyor means including driven gear means adapted, when said conveyor means has rotated a predetermined amount, to permit the rinse tank to empty to a predetermined level and then to be refilled with clean water simultaneously with the addition of a sanitizer, said driven gear means being rotatable and including a perimeter gear located beneath said conveyor means, a drive gear meshing with said perimeter gear, first and second radially spaced trip levers depending from said conveyor means and each engagable with an associated plunger adapted to activate an associated micro-switch and solenoid.

2. A glass washing machine according to claim 1 when upon rotation of said perimeter gear, said first trip lever engages its said associated plunger thereby activating the latter's said associated micro-switch and solenoid to open an outlet in said rinse tank and permit the water therein to exit.

3. A glass washing machine according to claim 2 wherein upon continued rotation of said perimeter gear, said second trip lever engages its said associated plunger thereby activating the latter's said associated micro-switch and solenoid to permit water to enter and fill the rinse tank to a predetermined height.

* * * * *